United States Patent [19]

Kerman

[11] Patent Number: 5,075,980

[45] Date of Patent: Dec. 31, 1991

[54] METHOD AND APPARATUS FOR DETERMINING ALIGNMENT OF WEB OFFSET PRINTING PRESS COMPONENTS

[76] Inventor: Mark Kerman, 1734 Winthrop Rd., P.O. Box 1335, Highland Park, Ill. 60035

[21] Appl. No.: 559,428

[22] Filed: Jul. 23, 1990

Related U.S. Application Data

[63] Continuation of Ser. No. 374,597, Jun. 30, 1989, abandoned, which is a continuation of Ser. No. 648,604, Sep. 7, 1984, abandoned, which is a continuation-in-part of Ser. No. 572,229, Jan. 19, 1984, abandoned.

[51] Int. Cl.[5] ..... B41B 11/00

[52] U.S. Cl. ..... 33/618; 33/614; 33/832

[58] Field of Search ..... 33/614, 617, 618, 832, 33/833

[56] References Cited

U.S. PATENT DOCUMENTS

| | | | |
|---|---|---|---|
| 2,095,542 | 10/1937 | Claybourn | 33/184.5 |
| 2,627,118 | 2/1953 | Young | 33/172 B |
| 2,787,836 | 4/1957 | White | 33/172 B |
| 3,367,612 | 2/1968 | Usiskin | 33/172 R |
| 4,367,594 | 1/1983 | Murray | 33/172 R |
| 4,383,760 | 5/1983 | Deter et al. | 33/184.5 |

FOREIGN PATENT DOCUMENTS

| | | | |
|---|---|---|---|
| 327762 | 2/1958 | Switzerland | 33/184.5 |

*Primary Examiner*—Thomas B. Will

[57] ABSTRACT

A method and apparatus for determining the degree of alignment or misalignment of various web offset lithograph printing press components is disclosed. An alignment block is provided having one surface with a modified curved "v" contour, and with a plurality of receptacles for holding register measuring components. The remaining sides of the alignment block are planar and mutually perpendicular. Register measuring components can be attached to extensions placed within the receptacles and those register measuring components are used to measure deviation of web offset press components from a reference point in the press. The alignment block is adaptable to receive dowel pins in the receptacles, which form a corner with the blocks that can be simply and easily placed upon a precisely positioned reference positions on the frame of a color unit of a web offset press. Measurement of misalignment is accomplished by comparing distances from various reference points or press components, through use of a displacement gauge attached to extensions which in turn are attached to the block. The gauge and block combination is moved to measure the distance variations from the reference points to segments of press components. For plate to plate cylinder register, a measuring scale is provided that is flexibly conformable to the plate and mateable with a side of the alignment block. An illuminated magnifier is mountable in one of the block receptacles and positionable to improve the ease of reading the markings on the scale and the register marks on the plate.

23 Claims, 5 Drawing Sheets

METHOD AND APPARATUS FOR DETERMINING ALIGNMENT OF WEB OFFSET PRINTING PRESS COMPONENTS

This is a continuation of application Ser. No. 07/374,597 filed June 30, 1989, now abandoned, which is a continuation of application Ser. No. 06/648,604 filed Sept. 7, 1984 and now abandoned, which is a continuation-in-part of my prior co-pending application Ser. No. 572,229, filed Jan. 19, 1989, now abandoned.

BACKGROUND OF THE INVENTION

This invention relates to web offset printing presses, and more particularly, it relates to a method and apparatus for determining the dimensional amount of alignment or misalignment of various components of a web offset lithograph printing press, composed of one or more printing units.

Web offset lithograph printing is normally accomplished through use of a three cylinder printing process. The first cylinder is known as a "plate" cylinder, and is surrounded by a metallic image plate. The image is inscribed on the plate and ink is applied to the plate image. The plate cylinder is in adjustable rolling contact with a second cylinder, known as a "blanket" cylinder surrounded by a "blanket" of a rubberized material. The rolling contact of the inked plate on the plate cylinder to the blanket cylinder transfers the inked image from the plate to the blanket. A continuous "web" of paper from a paper roll is driven between the blanket cylinder and a third cylinder known as an "impression cylinder" at a point diametrically opposite the point of contact between plate and blanket cylinders (a point known as the "impression nip"). All cylinders are maintained in impression contact with each other, with the pressure between cylinders known as "squeeze pressure". Squeeze pressure from the cylinders onto the web as the web is driven between the blanket and impression cylinder offsets the inked image from the blanket cylinder to the top of the web.

Most cylinder designs have bearer rings at each end as a major diameter (the largest diameter of the cylinder and bearer ring combination) extending beyond the plate and blanket mounting area. The plate and blanket cylinder body diameter, between the cylinder bearer ends, is undercut to a lesser or "minor" diameter, leaving a space for the plate or blanket. Paper sheets, known as "packing", are wrapped about the cylinder beneath the plate or blanket. Typically, blankets extend four one-thousandths of an inch above the bearer rings, and plates extend one-thousandth of an inch above the bearer rings. During printing the bearer rings are in rolling contact, a condition known as "impression on". The paper sheets, or "underpacking", lift the plate and blanket above the bearer rings and create the printing "squeeze pressure" during "impression on".

The combination of a plate cylinder and a blanket cylinder in rolling contact is known as a "couple". The web can be printed on both sides by using a pair of couples, one with a first plate cylinder rotating above its corresponding blanket cylinder, and one with a second plate cylinder rotating below its corresponding blanket cylinder. The cylinder couple pairs can be arranged with cylinder center lines generally stacked vertically, with cylinder center lines generally set horizontally side-by-side, or with cylinder center lines in a generally staggered vertical stack. The web receiving its inked impression is driven between the two rotating blanket cylinders. When the web is simultaneously printed on both sides in the above manner, each blanket cylinder is the impression cylinder for the other, and the printing unit is known as "perfecting".

Multi-color offset lithograph printing is accomplished through application of different colors of ink in successive stages, with printing accomplished at each stage by individual printing units of the press, each printing unit using the process described above. A single couple with an impression cylinder (or a pair of couples) is used to print the web on one or both sides in a first color; the web is then driven to a subsequent printing unit, also having a single couple with an impression cylinder (or a pair of couples), wherein a second color is printed over the first color image. Full color printing requires four colors (black and the three primary colors) and thus four printing units. Naturally, precise alignment of the various printing units and the components of each printing unit is necessary to ensure that all colors are properly printed and the final multcolor image is sharp and not blurred. Such color-overcolor alignment is termed "register".

Efficient operation of a web offset printing press requires proper alignment or register of all components in the press, within one to a few thousandths of an inch. Ideally, all components in a web offset printing press will be exactly aligned. The plate should be properly aligned when wrapped around the plate cylinder so that "register marks" inscribed on the plate coincide with each other, producing "pre-register" of the plate cylinder. The plate cylinder should be exactly aligned with its longitudinal axis parallel to the longitudinal axis of the blanket cylinder if the plate cylinder and plate image are straight. The packing beneath the plate or blanket in both the plate cylinder and the blanket cylinder must properly set the height of the plate or blanket with respect to the bearer rings. In mult-color offset printing, components of each color printing unit must be properly aligned with corresponding components of subsequent and preceding color printing units.

Control of proper alignment or register of the components of an offset web press poses a substantial problem to the printing industry, primarily because misregister can result from a large variety of separate factors. Generally, misalignment can result from three broad areas: a printing press can be improperly designed or manufactured, such that a new press when installed has components out of proper alignment. Alternatively, operation of a press can cause various components of the press to move out of alignment, principally as a result of the vibration or paper jams produced by the press' operation. Finally, various components of the press can be improperly adjusted by the press operators.

Proper alignment or "register" of images, especially in multi-color printing, requires attention to a number of factors. Plate to cylinder register is accomplished by pre-aligning the marks directly opposite each other. Such alignment will also ensure that the plate is square to the plate cylinder, if the image is square to the plate and the plate has been accurately wrapped and locked around the plate cylinder.

Additional misalignment problems can result from the position of the various cylinders with respect to each other. Two kinds of cylinder misalignment are especially troublesome: "angular" error, and "offset" error. Angular error, also known as "misalignment", occurs when cylinders do not have their longitudinal axis or "center lines" parallel. Offset error occurs when the center lines of the cylinders are parallel but the distance between those center lines is improper. Angular and offset error can occur individually, or those errors may occur together in a compound of angular and offset error. Angular and offset error can occur between individual cylinders in a single press unit, or with respect to other press units for different colors. Angular and offset error can also occur with respect to the mounting frames of individual press units.

Other alignment errors are more easily corrected. When the position of a plate cylinder with a plate is laterally improper, the cylinder position can be corrected by moving it along its longitudinal axis toward one side of the press frame. When the position of a plate cylinder with a plate is circumferentially improper, the cylinder position can be corrected by moving it circumferentially around its longitudinal axis. These adjustments are normal register adjustments.

Additionally, the packing surrounding each cylinder must set the plate or blanket to the proper height above the bearer rings. Packing is an intermediate material, usually paper, that surrounds both the plate or blanket cylinders, underneath the plate or blanket, and raises the height of the plate from the cylinder's undercut mounting diameter.

When properly installed, the packed plate and blanket cylinders each apply an opposing predetermined squeeze pressure upon the plate, blanket and paper web. Improper packing can produce improper squeeze pressure at the impression nip. Improper squeeze pressure across the linear impression nip of both the plate and blanket cylinder nips can cause improper ink transfer and/or produce a distorted image.

Each color press unit must also be precisely aligned with preceding and subsequent color press units. Printing presses are normally manufactured with each color press unit in precise three dimensional alignment with the other units. Each press unit is normally affixed to a permanent concrete foundation designed to support the load and avoid drift or shift of the units out of alignment. However, such misalignments can occur during erection or use of the press, or from settling of the foundation, or movement due to shock or other stresses placed upon the press units or their foundations.

Improper register or misalignment of the various components of a web offset printing press results in two principal problems: first, extensive trial and error adjustments, each requiring a printing run, become necessary before the plate images on a multi-color printing process can be placed in placed proper register. Often they cannot register. The plate cylinders often must be cocked, and the lateral and circumferential plate to plate cylinder register often must be varied to ensure proper image register; much paper and time can therefore be wasted. Large printing presses are expensive to operate, so that the preregister maintenance for maximum efficiency will result in expending as little time as possible when making production adjustments on the press, thus leaving the press in a pre-registered and operable condition for a maximum portion of time.

Reduced service life of the press components can also result from misalignment or misregister. The adjustments necessary to place an image in register often require the components of the press to be operated with substantial misalignment (although the resulting image can appear registered). In the case of high-speed, printing presses, such misalignment can cause excessive bearer ring load and squeeze pressure, producing overloads that result in excessive wear of gears, bearings, bearer rings and other rolling contact pressure points, thereby substantially reducing the life of many moving parts in the printing press. It is therefore desirable to discover and correct the source of alignment error to place the printing press printing cylinders and image correctly in register as quickly as possible, and accomplish that register with the various press components having as little misalignment as possible.

OBJECTS OF THE INVENTION

Accordingly, it is an object of this invention to develop a method and apparatus for quickly determining plate to plate cylinder register or misregister in a web offset lithograph printing press.

It is a further object of this invention to develop a method and apparatus for quickly determining the degree of alignment between the frame of a printing unit and any roller, shaft, or cylinder in that unit.

Another object of this invention is to provide a method and apparatus for quickly and easily measuring to determine whether the desired quantity of packing has been placed between the plate or blanket and the plate or blanket cylinders in a web offset printing press.

A further object of this invention is to provide a method and apparatus for determining if air spaces are present beneath a plate in the vicinity of a web offset press plate cylinder lock-up slot.

Still another object of this invention is to provide a method and apparatus for determining if each of the various color units in a web offset press are in alignment with preceding and subsequent units.

Yet another object of this invention is to provide a method and apparatus for aligning various component parts that is easily operated and inexpensive to construct.

Still a further object of this invention is to provide a method and apparatus for determining alignment of various components of a web offset printing press that is adaptable to evaluation of multiple kinds of press component alignment.

Another object of this invention is to provide a method and apparatus for determining web offset component alignments that is useable within the cramped interior of each unit of a web offset printing press.

Yet a further object of this invention is to provide a method and apparatus for determining alignment of various components of a web offset printing press, with the apparatus operable by a single person without assistance.

A further object of this invention is to provide a method and apparatus for determining if each cylinder of the various color units in a web offset press are in proper alignment with the corresponding cylinders of preceding or subsequent color units.

Another object of this invention is to provide a method and apparatus for determining bearer ring wear in a web offset printing press.

A further object of this invention is to provide a method and apparatus for determining the sources of plate cracking in a web offset printing press.

SUMMARY OF THE INVENTION

These and other objects of the invention are accomplished by providing an apparatus with multiple adaptable alignment features. An alignment block having a "v" contour or one surface, with a modified curved "v"

contour, is provided with a plurality of receptacles for holding register measuring components. The alignment block has a plurality of perpendicular planar sides. Register measuring components can be attached to extensions placed within the receptacles and those register measuring components are used to measure deviation of web offset press components from a reference point in the press unit, or with respect to corresponding reference points of other units. The alignment block is adaptable to receive dowel pins in the receptacles, which form a corner with the block that can be simply and easily placed upon precisely positioned reference points on the frame of a particular color unit of a web offset press. Measurement of misalignment is accomplished by comparing distances from various reference points or press components, through use of a displacement gauge attached to extensions which in turn are attached to the block. The gauge and block combination is moved to measure the distance variations from the reference points to segments of press components. For plate to plate cylinder register, a measuring scale is provided that is mateable with a planar side of the alignment block and flexibly conforms to the surface of a plate cylinder. An illuminated magnifier is mountable in one of the block receptacles and positionable to improve the ease of accurately reading the markings of the scale.

DETAILED DESCRIPTION OF THE PREFERRED EMBODIMENT

Figure 1:
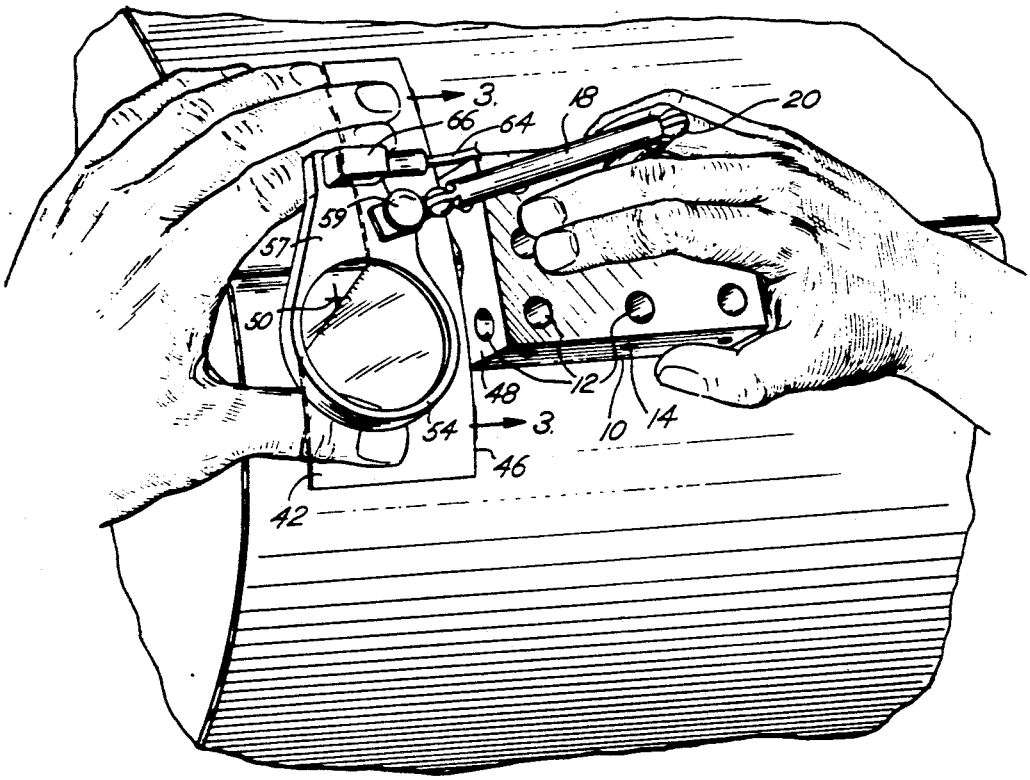
FIG. 1 is a perspective illustration of the apparatus of the invention in use to determine plate to plate cylinder misregister in a web offset printing press.
Figure 2:
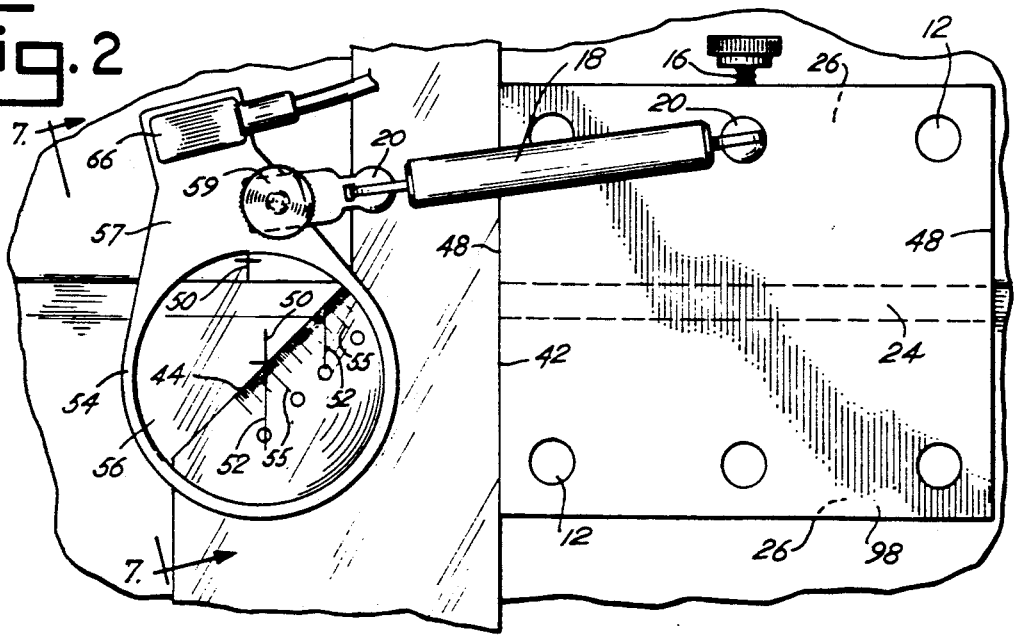
FIG. 2 is a plan view of the apparatus of the invention in use to determine the amount of misregister of a plate to a plate cylinder in a web offset printing press.

Referring now to the figures, the following detailed description of the preferred embodiment of the invention is provided. In the following description, terms such as left, right, up, down, front, back, upper and lower etc. are for convenience of illustration and explanation only, and should not be considered a limitation of the scope of the invention unless such terms are expressly included within the claims.

A first application for the preferred embodiment of the invention is illustrated in FIGS. 1 through 7. Generally, the invention uses an alignment block 10 having a plurality of perpendicular sides, and having a plurality of receptacles 12 in some of the sides. In the preferred embodiment, the top side 98 has six receptacles, and each end 48 has two receptacles. Each receptacle 12 has an intersecting threaded opening 14 for insertion of a threaded thumb screw 16. Various extension members 18 may be inserted into the receptacles 12 and those extension members may be affixed to the alignment block 10 by tightening the thumb screw 16. In the preferred embodiment, the extension members may have a variety of different forms, and may have elbow connections 20 allowing the extension member 18 to adapt to a variety of different positions from any of the receptacles 12.

In the preferred embodiment, the alignment block 10 has a concave lower surface 22 of a generally "v" shaped cross-section. The lower surface 22 is composed of three main components: a flat planar portion 24 and two curved generally convex legs 26 on either side of the flat planar portion 24. Each of the three portions extends with a uniform cross-section along the entire length of lower surface 22.

The particular shape of the lower surface 22 of the alignment block 10 is selected to allow precise alignment of the alignment block 10 with the longitudinal axis of a cylindrically curved surface. In offset web printing presses, the cylindrically curved surface of interest is the surface of either a plate mounted on a plate cylinder, or a blanket mounted on a blanket cylinder and the undercut diameter below.

Figure 3:
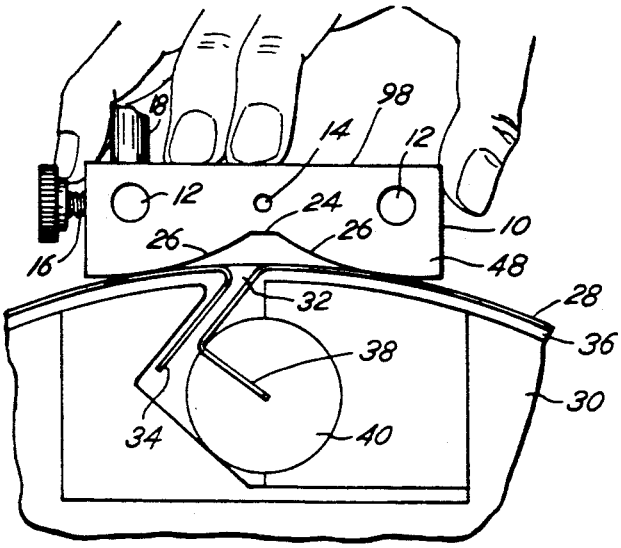
FIG. 3 is a left-side view of the apparatus shown in FIG. 1, also illustrating the plate cylinder lock-up slot.
Figure 4:
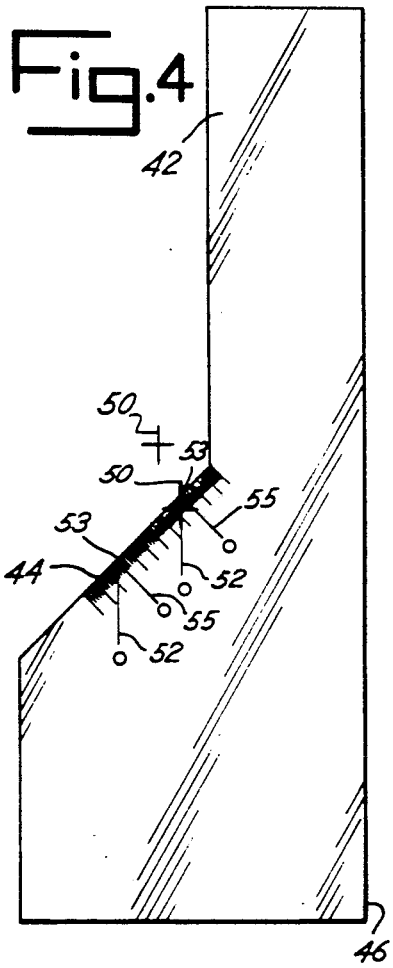
FIG. 4 is a plan view of the flexible scale used to measure plate register deviation.
Figure 5:
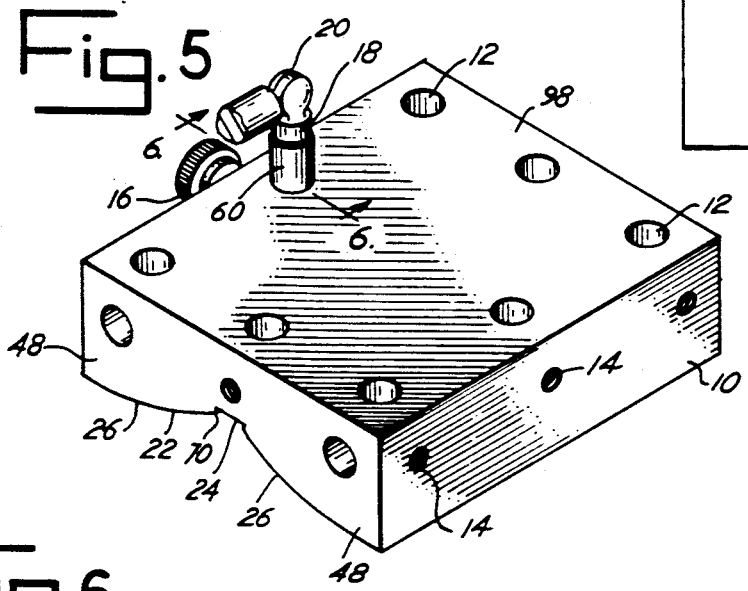
FIG. 5 is a perspective view of the alignment block illustrating receptacles, an extension member, and a thumb screw to hold the extension member in a receptacle.

FIGS. 1 and 3 illustrate use of the alignment block on the cylindrical surface of a plate 28 attached to a plate cylinder 30. The plate is usually constructed of a metallic material, and is normally pre-bent at both ends to fit into a lock-up slot 32 of the plate cylinder 30. To install the plate 28, packing material 36 is attached to the plate, and the pre-bent leading edge 34 of the plate 28 is slipped into the lock-up slot 32. The trailing edge 38 is then wrapped around the plate cylinder 30 and inserted into the lock-up slot 32. Once the plate 28 has been installed, the packing material 36 completely surrounds the plate cylinder 30 under the plate 28. The plate 28 is then tightened over the plate cylinder 30 by rotating tightening cylinder 40.

The shape invented for use on the lower surface 22 of the alignment block 10 allows the alignment block to be aligned parallel to the longitudinal axis of the plate cylinder 30 for a variety of plate cylinder diameters. Because the lower surface 22 of the alignment block 10 has curved legs 26 rather than simple straight linear legs as in a conventional "v" block, a lesser area of the block's surface is in contact with the surface of the plate 28 so that a more precise alignment of the contact between the alignment block 10 and plate cylinder 30 easily results.

The shape of lower surface 22 also produces a positive seated "feel" when the alignment block 10 is positioned on a cylindrical surface. In the preferred embodiment, each curved leg 26, when viewed in cross-section similar to that shown in FIG. 6, defines a curve described by the following third order LaGrange polynomial:

$$y=a+bx+cx^2+dx^3$$

where, in the preferred embodiment, a is 1.011240409, b is 0.034583553, c is 0.171601488 and d is 0.011341215. The above expression defines the line forming the curve in a cross-section of the lower "v" surface of the alignment block, when the alignment block is inverted with the "v" surface on the top, and only one curved leg 26 is considered. The coordinate axis has its reference point at the intersection 70 of the curved leg 26 with the flat portion 24. To ensure accurate alignment of the block 10 with the longitudinal axis of the cylinder 30, the preferred embodiment of the block 10 is machined to precise tolerances so that total accumulated error is not more than one ten-thousandth of an inch.

The alignment block 10 is used in conjunction with a register reading scale 42 having a series of scale markings 44. The register reading scale 42 has a linear edge 46, preferably positioned at an angle to the scale markings 44 to allow, in conjunction with the register marks 50 acting as pointers, a "vernier" measurment. In the embodiment displayed, the linear edge is at a 45-degree angle to the scale markings; the 45-degree angle increases accuracy of measurement by making the scale markings 1.414 times as visable, making the measurements 1.414 times as accurate as parallel scale markings. In an alternative embodiment, the scale markings are positioned at a 60-degree angle and are thus twice as visable and correspondingly are twice as accurate.

In the preferred embodiment, the markings 44 have two "zero" positions 53 which may be used as reference points from which misalignment of the register marks may be measured. The preferred embodiment of the scale 42 is marked with both "zero" lines 52 extending parallel to side 46 and "zero" lines 55 extending at an angle to side 46. In the preferred embodiment, the scale 42 is composed of a flexible, transparent material that can conform to the shape of a variety of different diameter cylinders; the scale divisions are marked on the bottom of the scale 42 so that the markings 44 are in direct contact with the register marks 50, and paralax error is thereby avoided, when viewed through the magnifier at any angle.

In operation, the alignment block 10 is placed on the plate cylinder 30 and aligned by "feel" with the longitudinal axis of the plate cylinder. The straight linear edge 46 of the register scale 42 is then placed in linear contact with the forward surface 48 of the block 10. In the preferred embodiment, the forward edge may be either of the planar edges of the alignment block 10 that defines a cross-section of the lower surface 22. The alignment block 10, along with the register scale 42, is then moved so that portions of the scale markings 44 come in contact with one of the register marks 50. For ease of use, the block 10 and scale 42 should be positioned so that the first register mark 50 is located at one of the zero positions 53 of the scale markings 44. The register scale 42 is then slidably moved along the forward edge 48 of the alignment block 10 until the scale markings 44 contact the remaining register mark 50, and a reading of the amount of misregister on the scale markings 44 may then be determined and recorded from the position of the remaining register mark 50 on the scale markings 44. The position of the remaining register mark 50 on the scale markings 44 is the linear displacement of the register marks, which in turn is the amount of misalignment of the plate or plate image with the plate cylinder.

In the preferred embodiment, visual reading of the scale markings and register displacement is eased through use of an optical magnifier 54 attached to an extension member 18. The optical magnifier is best seen by reference to FIGS. 1, 2, and 7. In the preferred embodiment, the optical magnifier is mounted on a lens board 57 attached to the extension member 18 through use of a plurality of elbow connections 20, so that the optical magnifier may be easily positioned in a variety of locations and all register marks can be easily viewed through the magnifier. The lens board 57 is preferably attached to the extension member 18 with a thumb screw 59. In the preferred embodiment, the lens 56 of the optical magnifier 54 is aspheric so that an undistorted image is produced not only at the center of the lens 56 but near the edge of the lens 56 as well.

Figure 6:
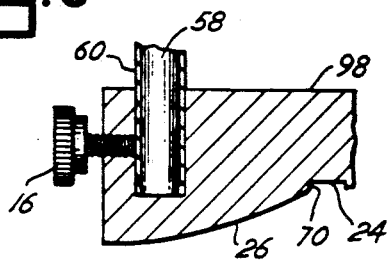
FIG. 6 is a cross-section of the receptacle and extension member illustrated in FIG. 5.

As illustrated in FIG. 6, adjustability of the position of the optical magnifier 54 in the preferred embodiment is further accommodated by making rod 58 rotatably mounted within a sleeve 60. In the preferred embodiment to maintain position, the rod 58 is mounted with a movable friction fit in the sleeve 60, so that rotation of the rod 58 occurs only with some effort without damage to the rod 58, even when thumb screw 16 is tightened.

Figure 7:
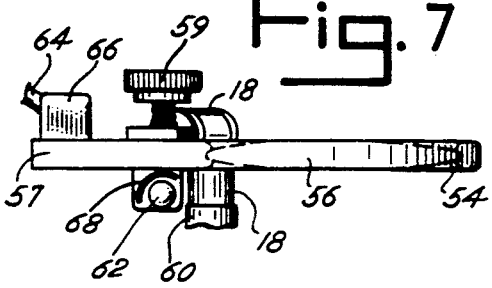
FIG. 7 is a left-side view of the optical magnifier shown in FIG. 2 illustrating illumination of the visual area beneath the optical magnifier.

The preferred embodiment of the invention also includes illumination of the scale markings 44 and register marks 50 in the immediate vicinity of the optical magnifier 54. As illustrated in FIG. 7, such illumination is preferrably accomplished through use of an electric light bulb 62 mounted under the lens board 57 and near the lens 56. To minimize space, the electrical lead 64 of the power source (not shown) for the bulb 62 is mounted on the optical magnifier 54 on the side opposite the bulb 62. In the preferred embodiment, the electric lead is removably attached by a plug and socket arrangement 66 to the optical magnifier 54. Also in the preferred embodiment, the electric bulb has a reflector 68 to direct light toward the register marks 50 and scale markings 44 and is positioned to eliminate register mark or scale line shadows upon either target.

The embodiment of the invention described above can also allow determination of when the register marks are out of alignment by checking against any straight part of the image. If all press components are determined to be in proper register, including the plate to the plate cylinder, and an image out of register still results during initial printing for running register, this indicates that the register marks are not in proper alignment with the image and the plate. The plate must be remade, and the image placed in register with the register marks before another printing run is attempted.

Alternative embodiments of the alignment block 10 with concave lower surface 22 can be used that vary the width of the flat planar portion 24, or that include a hinge (not shown) with a step at the flat planar portion 24, so that the legs 26 may be pivotably moved closer to or away from each other, and fixed at such positions. Such variations allow alignment blocks to be used more effectively on different ranges of diameters of cylindrical surfaces.

Figure 8:
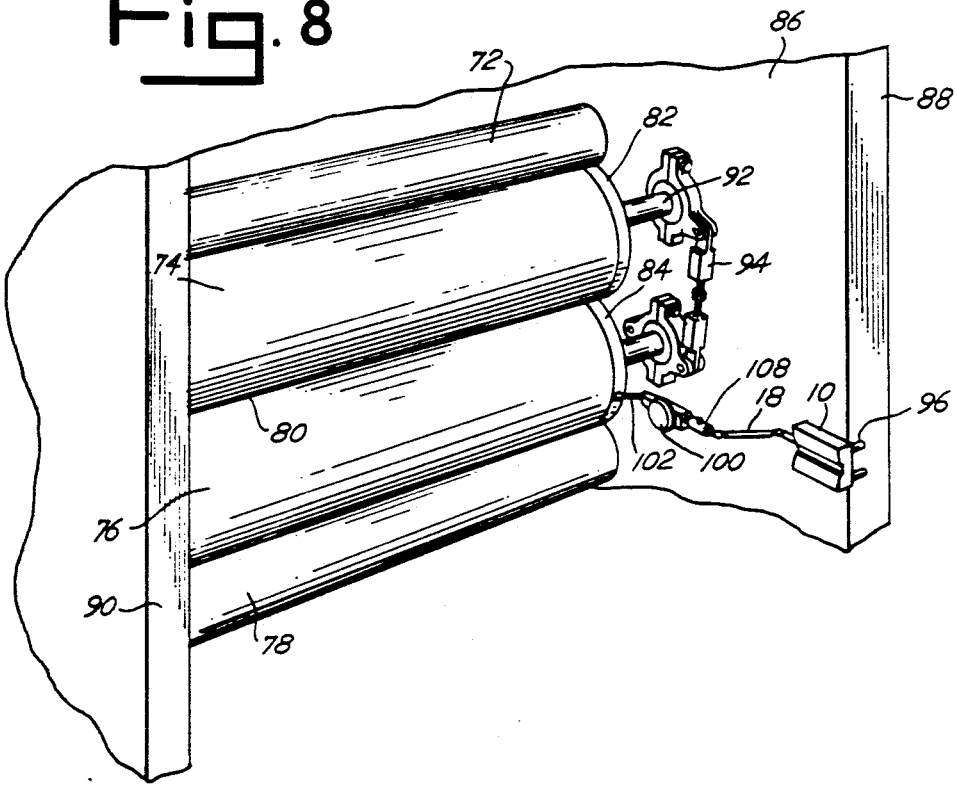
FIG. 8 is a perspective view of a pair of web offset press couples arranged for dual-sided printing with the apparatus of the invention set up to measure alignment or misalignment of a cylinder from the bearer ring.
Figure 9:
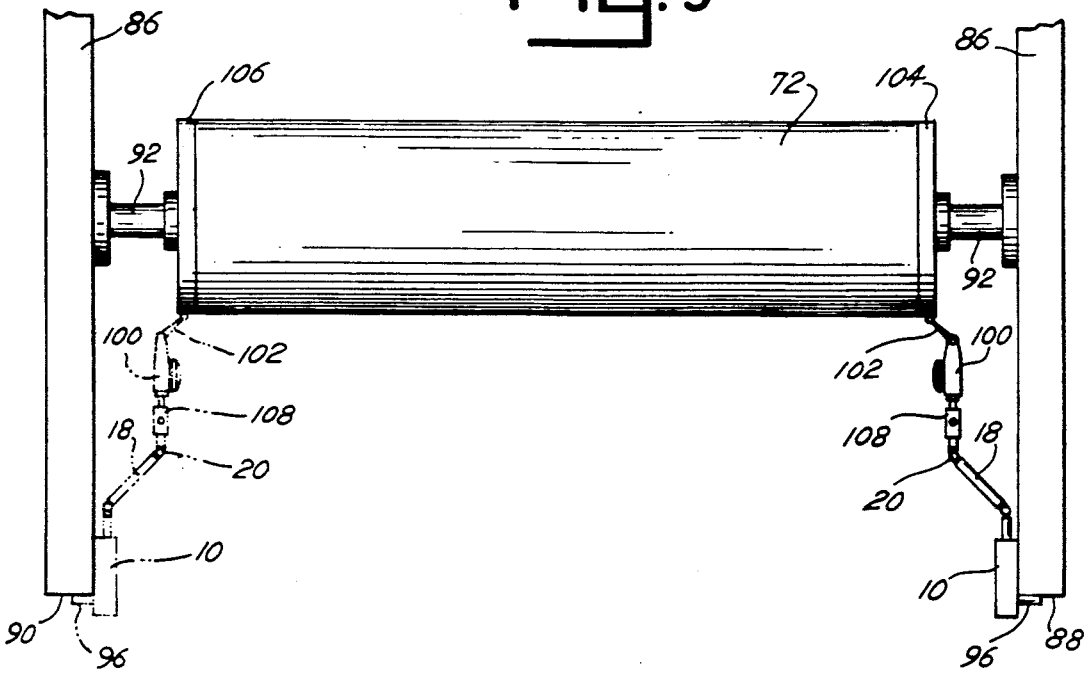
FIG. 9 is a plan view of the apparatus and set up of FIG. 8, also illustrating the method of the invention shown in FIG. 8.
Figure 10:
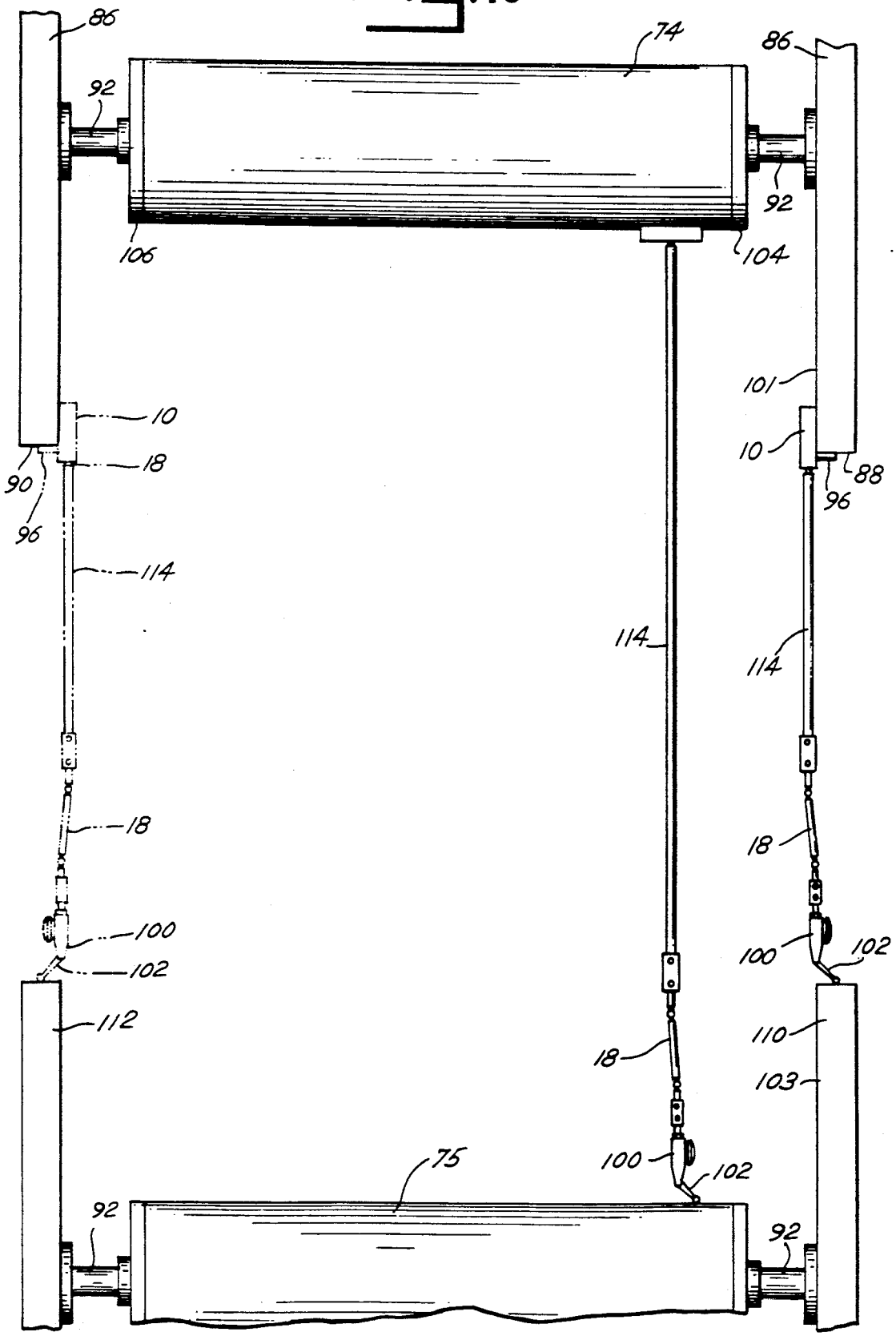
FIG. 10 is a plan view of the apparatus of the invention set up to determine alignment or misalignment of the frames of adjacent color units, and alignment or misalignment of the cylinders of adjacent color units.

Referring now to FIGS. 8, 9, and 10, the alignment block 10 has other applications for aligning web offset printing press components. FIG. 8 illustrates a typical dual-couple arrangement for dual-sided printing on a web offset lithograph printing press, including portions of the cylinder bearers 84, 104, 106 used as a reference to adjust the cylinders. An upper plate cylinder 72 is mounted in rolling contact with an upper blanket cylinder 74. Beneath those cylinders is a lower blanket cylinder 76 in rolling contact with the upper blanket cylinder 74, and beneath that is a lower plate cylinder 78 in rolling contact with the lower blanket cylinder. The web (not shown) passes between the upper blanket cylinder 74 and the lower blanket cylinder 76, at the "impression nip" 80. Load pressure between the two blanket cylinders is applied not only across the impression nip 80, but between the upper blanket cylinder bearer rings 82 and the lower blanket cylinder bearer rings 84. The plate and blanket cylinders are mounted onto a support frame 86 having on the left or "gear" side a front side 90 and on the right or "operating" side an opposite front side 88. Each cylinder's axle end is rotatably mounted within the frame 86 within various single and dual eccentric bearing box configurations 94. Each cylinder's axial end is rotatably mounted within the frame 86 within various single and dual eccentric bearing box configurations (not shown) that are stroke adjustable by internal and external linkages or devices similar to configuration 94 in function. The turnbuckle linkage configuration 94 allows adjustment of the eccentric position of each end of the cylinders with respect to the support frame 86 and the other cylinder.

Use of the invention to determine the amount of erroneous cocking and misalignment of the various cylinders is illustrated in FIGS. 8 and 9. Cylinder to frame alignment is accomplished by configuring the block 10 as a "corner block." In the preferred embodiment, of use of a corner block, or cornering block, a pair of dowel pins 96 are inserted into two of the receptacles 12 on the top side 98 of the alignment block 10 opposite the concave lower surface 22. The dowel pins, together with the planar top side 98, form a right angle corner that is a positive gauging stop. Typically, when web printing press frames are manufactured they are pinned in pairs so that front sides 88 and 90 have equal right angle corners. Consequently, when holes are bored through the paired frames for the adjustable single and double eccentric bearing boxes (not shown) for cylinder axle 92, the location of the frame holes (not shown) to the front side of both frames becomes the exact same distance. The front sides 88 and 90 may then be used as exact reference points for measuring and adjusting (pre-register) cocking or any other eccentric misalignment register error of the cylinders to the frames or to each other, to zero. A displacement gauge 100 with an actuator lever 102 can therefore be attached through the extension member 18 to the alignment block 10 by insertion of the extension member into one of the alignment blocks receptacles 12. Intermediate coupling 108 might be necessary to adjust the proper distance between the alignment block 10 and the displacement gauge 100.

To determine the amount of plate cylinder cocking, (or amount of any misalignment with respect to front sides 88 and 90) the above-described arrangement of the displacement indicating gauge 100 attached to an alignment block 10 is adjusted so that the lever 102 contacts in reading range against the gear side bearer ring 106 (as shown in FIG. 9). This first maximum reading on the displacement gauge 100 is then set to zero by moving the configuration along front side 88. The zero reading of the displacement gauge is the shortest measured distance from front side 88 to bearer ring 106. Next, the block and gauge configuration is turned over and moved across the press to the opposite side of the support frame 86 at a position corresponding to that used on front side 88 and placed with the corner of the alignment block 10 resting against the other front side 90, where it can again slide up and down. The displacement reading of the gauge is then again determined, by finding the maximum displacement reading of the lever 102 on bearer ring 106. The maximum displacement reading on the gauge is the cocking or misalignment of the cylinder.

The displacement gauge 100 may be any standard indicating displacement gauge that records displacement of a piston on a visual scale. The operation of such gauges is well known to persons skilled in the art, and such gauges are exemplified by the Series 513 "Quick Set" dial test indicators manufactured by Mitutoyo Company.

Most web offset presses have integral cocking pointers over a machine scale which are constructed to indicate to a press operator the cocked position of the plate cylinder in each unit. However, such gauges are often in error and cannot be precisely calibrated. This invention therefore allows a precise determination of the exact amount of plate cylinder cocking and blanket cylinder misalignment which in turn allows calibration of the presses integral plate cylinder gauges and precise alignment of all cylinders.

Misalignment and cocking of the plate cylinders and misalignment of the blanket cylinders can be measured from any vertical reference point on either of the two frames 86.

Use of the invention to determine alignment of preceding or subsequent color units in a web offset printing press is illustrated in FIG. 10. A cylinder 74 is shown in FIG. 10 attached to a frame 86 for a particular color unit. A second color unit, shown in FIG. 10 as a preceding unit, is illustrated by showing its operating frame 110 and opposite side frame 112, and with cylinder 75 between the frames.

When a web offset printing press is initially installed at a location, the manufacturer attempts to ensure that the units are precisely aligned; however, such precise alignment does not always occur. Misalignment can also result over the years due to operation of the press, or from shocks, foundation settling, paper jam accidents to the cylinder or other unusual displacement of the frame. To determine if the frames 110 and 112 of a color unit are in alignment with subsequent or preceding frames 88 and 90, the alignment block 10 is again constructed as a corner, or cornering block with dowel pins 96 inserted into receptacles 12 to create a corner matching the frame corners. An extension member 18 is, as shown in FIG. 10, attached to a bridge extension rod 114 of much greater length than extension member 18, and adapted to extend for most of the distance between units. A second extension member 18 is connected to the end of the extension rod 114 with a displacement gauge 100 attached at the end of the second extension member 18.

The invention determines unit misalignment through use of a procedure similar to that used for measuring plate cylinder cocking or blanket cylinder misalignment. The displacement gauge is set up with its actuator lever 102 in contact with the face 105 of frame 110 of the preceding unit, and the lever 102 is zeroed. The arrangement of the alignment block 10, extension members 18, bridge extension rod 114, and displacement gauge 100 is then turned over and shifted to the opposite side frame 112 of the press, and the displacement gauge's reading from zero is determined. The difference is the misalignment between the color unit to unit frames.

Still another application for the apparatus of this invention relates to lateral alignment or misalignment of press frames to each other. To evaluate such alignment or misalignment, the alignment block 10, and displacement gauge 100 should be prepared in the configuration described above, except that the corner rods 96 should not be inserted into the block 10, and the length of the arrangement must exceed the distance between the press frames of two different units, such as the face-to-face distance between frames 86 and 110. The block 10 is then placed with one of its planar surfaces on a second precisely flat planar surface, having at least one dimensional length that is the same length as the distance from the alignment block 10 to the actuating lever 102. For press machinery, the surface of a press frame is often an appropriate precisely machined completely flat planar surface.

The displacement gauge 100 is then zeroed, with the actuator lever 102 in contact with the same flat planar surface that the planar side of the block 10 is resting against. Next, the block 10 is placed with the same planar side of that block against the surface of a frame, such as inside surface 101 of the frame 86, with the combination of elements extending between frames 86 and 110. While holding block 10 immobile and in full contact with surface 101, the actuator lever 102 is placed in contact with the corresponding surface of frame 110, that is, surface 103. The new reading on the displacement gauge 100 is the lateral misalignment between the corresponding frames of the press unit.

As is also shown in FIG. 10, the invention may be used to determine parallel alignment of cylinders or shafts to preceding and subsequent color units. For this alignment measurement, the block 10 is configured in alignment on the surface of a cylinder, with its concave side 22 in contact with that surface. A bridge extension rod 114 is connected at one end to a receptacle in the block 10 and at the other end to an extension member 18 attached to a displacement gauge 100. Cylinder to cylinder parallel alignment is determined by sliding the radially seated block on a short arc from a lateral position adjacent the bearer ring on cylinder 74 while the actuator lever 102 of gauge 100 is sweeping the opposite radial position on cylinder 75 to find the minimum measurable distance for setting zero. After zero is set subsequent radius to radius measurements are made from a second position laterally between the cylinders adjacent the opposite bearer ring on cylinder 74 to opposite cylinder 75. Any difference from zero is the out of parallel distance between the two cylinders.

Figure 11:
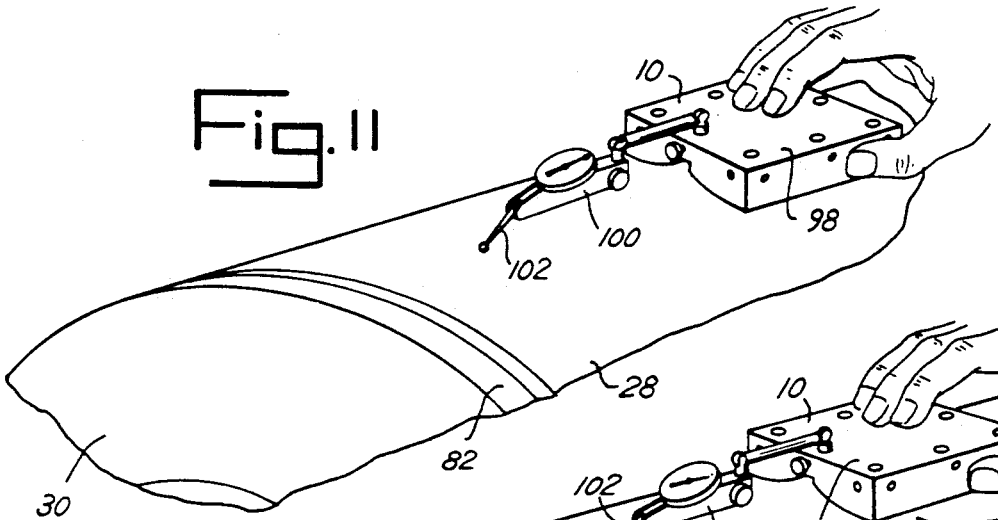
FIG. 11 is a perspective view of the invention in a zeroing configuration in preparation to measure packing heights or bearer ring wear.
Figure 12:
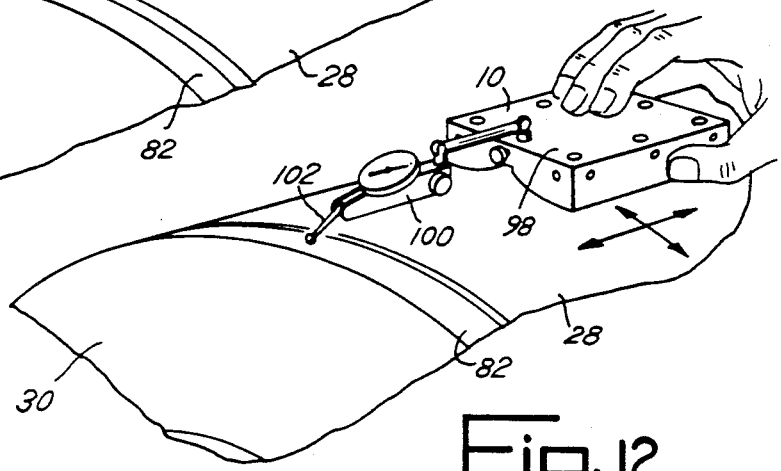
FIG. 12 is a perspective view of the invention in use to measure packing heights, illustrating a subsequent phase of the measuring procedure.

Still further applications for the invention, allowing measurement of packing heights or bearer ring wear, are shown in FIGS. 11 and 12. As illustrated in FIG. 11, measurement of the tensioned height of plates and blankets with packing underneath and wrapped about a plate or blanket cylinder 30, begins by presetting an arrangement of the block 10 and displacement gauge 100 to zero. The displacement gauge 100 is mounted in the block 10 in a position above the block's flat top surface 98 to measure zero displacement on the surface of the cylinder 30 at a position that aligns the displacement gauge with the block's longitudinal axis. The block 10 is then radially "seated" on that random axial position on the radial surface of the plate 28 (or blanket), along a single line on the radial surface of the plate 28 paralleling the axis of the cylinder 30. The displaced reading of the displacement gauge 100 along that line is then set to zero on the displacement gauge.

Measurement of packing height is illustrated in FIG. 12. Tensioned and run-in packing height is determined on the same line on the surface of the plate 28, paralleling the cylinder's axis for which the displacement gauge was zeroed. The block is again seated at any random radial position along that line with the lever 102 of the displacement gauge now contacting the surface of the cylinder's bearer ring 82. The reading of the displacement gauge is the true difference in height of the packed plate or blanket radial surface 82 above or below the height of the bearer ring 28 read along the measuring line. Mounting and manufacturing variations can still exist even though plates and blankets are specified by designers to be manufactured to precise free state thicknesses. Further, they can change, because of the stress from stretching during mounting from pressman assembly error, running, and production wear, and paper pile-up damage. Improper mounting or tensioning can also reduce height over bearers.

The mounted height of packed plates or blankets cannot be simply calculated before mounting in their free state, but must be measured with the block and gauge set-up after mounting when the gauge is zeroed on the radial surface of the blanket or plate, and then repositioned to the bearer ring. The dial reading of the actuator of the displacement gauge, seated on the bearer ring, is then the actual measurement of the difference in heights.

Using the identical process described above, the height of packing may be determined along other measuring lines at different radial positions about the cylinder's axis. Similarly, if the same process is applied directly to the surface of a cylinder not wrapped with either packing, a plate, or a blanket, the height of the bearer rings above the undercut at various locations radially about the cylinders's axis may be determined. Because the original diameters are known, measurement of later in service bearer ring height shows whether the bearer rings are worn, and if such wear has occurred evenly.

Figure 13:
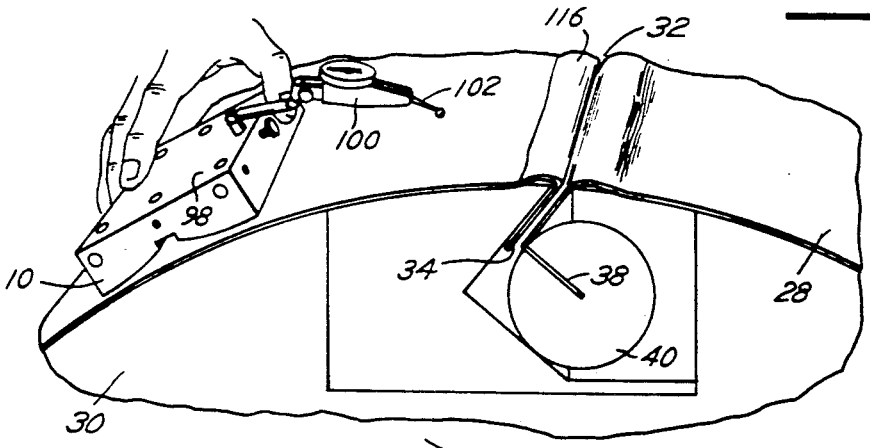
FIG. 13 is a perspective cross-sectional view of the invention in a zeroing configuration in preparation to measure plate "misfit" or "lock-up error".
Figure 14:
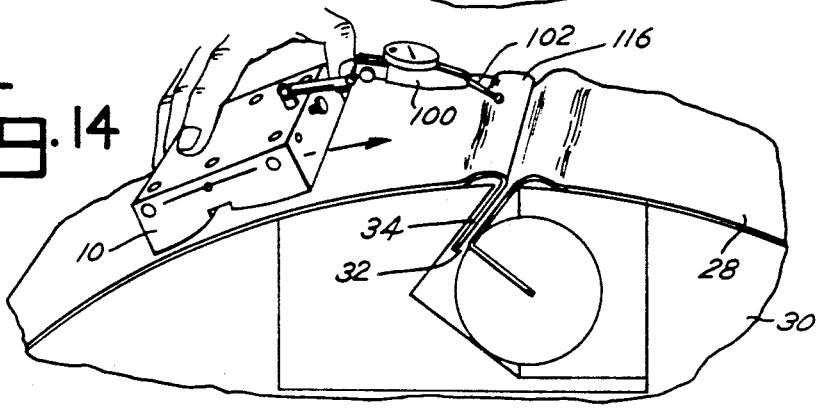
FIG. 14 is a perspective cross-sectional view of the invention in use to measure plate misfit in the vicinity of a web offset press lock-up slot.

Referring now to FIGS. 13 and 14, a final alternative application for the disclosed invention is illustrated. In addition to the applications disclosed above, the invention may be used to determine error in fit of a plate 28 near the lock-up slot of a cylinder 30. Plates are occasionally improperly bent, or improperly installed around the plate cylinder in the vicinity of the lock-up slot, such that an "air hump" 116 occurs either at the leading or trailing edge of the plate 28, or at both. Such an "air hump" can produce unnecessary periodic stress to the plate's surface at either bend, and create lateral nip "streaks" and eventually crack the plate due to cyclic stress.

As illustrated in FIG. 13, the invention may be used to determine the existence, size and location of such "humps." The invention is first configured with the displacement gauge 100 positioned on the block 10 by connecting it to the block's flat top side 98, such that the displacement gauge 100 measures vertical displacement at a point on the surface of the cylinder 30 removed along a line perpendicular to the block's longitudinal axis. The block 10 is then "seated" at a radial position along a single line extending about the circumference of the cylinder 30. The displacement gauge is then set at zero at any radial position that does not have surface discontinuities and that is removed from the vicinity of both the lock-up slot 32 and either lock-up slot edge.

As illustrated in FIG. 14, lock-up error is measured by moving the block and gauge combination radially along the same circumferential line around the cylinder, so that the displacement gauge lever 102 indicates displacement of the plate 28 in the immediate vicinity of the lock-up slot 32. The reading on the displacement gauge is the "hump" 116 of the plate in the vicinity of the lock-up slot. Such measurements can be made both at the leading and trailing edges of the plate. Using the same process, the location of "air humps" in the plate 28 may also be determined and mapped at a variety of positions along the length of the lock-up slot 32. Determination of the "air humps" size and location along the lock-up slot 32 thus allows the plate 28, plate bender (not shown) and bending techniques to be properly analyzed for correction. Using similar techniques to those described above, the block and gauge combination can be used to check the parallelism from radii to radii of the bending horns of a plate bender.

As should now be apparent, the present invention and the manner of using it has been described in such full, clear, concise and exact terms as to enable any person skilled in the art to which it pertains, to make and use the invention. Also, the best mode contemplated by the inventor of carrying out his invention has been set forth.

To particularly point out and distinctly claim the subject matter regarded as the invention, the following claims conclude this specification. Where an element in a claim is expressed as a means for performing a specified function without the recital of structure or act, the claim shall be construed to cover the corresponding structure or acts described in the specification and equivalents thereof.

What is claimed:

1. A mechanism for determining plate register of a plate having register marks in a web offset printing press, comprising, in combination:

an alignment block, having a longitudinal axis with a concave surface uniform cross-section along that axis, the surface being formed with an inverted generally "v" cross-section, with the legs of the "v" being continuously curved and separated by a linear segment, at least one of the block's remaining sides being planar and perpendicular to the longitudinal axis; and a register scale having a straight linear edge mateable with the side of the block that is perpendicular to and defines a cross-section of the curved surface, the scale further having visual markings arranged to measure displacement between register marks along an axis perpendicular to the scale's linear edge.

2. A mechanism as claimed in claim 1, further comprising an optical magnifier mountable on the alignment block and adapted to visually magnify the scale's visual markings.

3. A mechanism as claimed in claim 2 wherein the optical magnifier uses an aspheric lens.

4. A mechanism as claimed in claim 2, further comprising a source of illumination for the scale markings, the source being mountable upon the alignment block.

5. A mechanism as claimed in claim 2, wherein the source of illumination and optical magnifier are each attached to a variable position extension member, which extension member is mounted on the alignment block.

6. A mechanism as claimed in claim 1, wherein the scale's visual markings are arranged as a vernier measuring gauge.

7. A mechanism as claimed in claim 6, wherein the scale's vernier measuring gauge comprises a set of markings on the scale positioned at an angle to the scale's linear edge.

8. A mechanism as claimed in claim 5, wherein the block further comprises a plurality of receptacles mateable with the extension member, and the extension member is positionable in a plurality of positions relative to the block.

9. A mechanism as claimed in claim 8, wherein the receptacles comprise a plurality of first openings defined by the block in the planar sides of the block, each opening having a longitudinal axis, the longitudinal axis being perpendicular to at least one planar side of the block, each receptacle further having an internally threaded second opening defined by of the perpendicular planar sides of the block and intersecting the first opening, whereby a threaded bolt may be inserted into the second opening to securely fasten within the block any objects or extension members placed within the first opening.

10. A mechanism as claimed in claim 1, wherein the cross-section of each leg of the "v" of the block's concave surface defines the curve $$y=a+bx+cx^2+dx^3$$

where a is approximately 1.0112, b is approximately 0.0345, c is approximately 0.1716 and d is approximately 0.0113.

11. A mechanism as claimed in claim 10, where a is approximately 1.0011240409, b is approximately 0.034583553, c is approximately 0.0171601488 and d is approximately 0.011341215.

12. A mechanism for determining alignment of offset web printing press components for use in offset lithographic printing, comprising, in combination:

an alignment and cornering block having a plurality of planar sides, the block also having a plurality of receptacles;

two or more corner rods mateable with the cornering block's receptacles, the rods forming a perpendicular corner with one of the alignment block's planar sides when the rods are inserted into receptacles in the block;

an extension member mateable by at least one end thereof being insertable in a receptacle in the block, the measurement extension being rigidly positionable in a plurality of positions; and a gauge rigidly attachable to the measurement extension, the gauge having a variable position lever, with the gauge having means for indicating displacement of the variable position lever.

13. A mechanism for measuring misalignment of color stages in a multicolor web offset printing press, the stages being of the kind having a precisely aligned frame defining at least one reference point on each side of each stage's cylinders, comprising, in combination:

an alignment block having a plurality of planar sides;

means for positioning the alignment block on a reference point, the alignment block being at a first reference point when on a first side of the housing and at a second reference point when on a second side of the housing;

a gauge having a displacement lever and adapted to read displacement of the lever in a direction perpendicular to the block's side facing the subsequent press stage; and means for connecting the block to the gauge such that when the alignment block is positioned at the first reference point the lever is positioned against one side of the next stage's frame, and registering a first displacement and when the alignment block is positioned at the second reference point the lever is positioned against the second side of the next stages frame and registering a second displacement.

14. A mechanism as claimed in claim 13 wherein the means for positioning the alignment block on the frame comprises one or more dowel pins extending perpendicularly from a planar side of the alignement block forming a right-angle corner mateable with a reference point corner of the frame.

15. A mechanism as claimed in claim 13, wherein the means for positioning the block on the frame comprises a plurality of receptacles on each side of the block; and dowel pins removably mountable within the receptacles and forming a right-angle corner with the planar side of the alignment block having the receptacle and adapted to precisely position the block on any corner of the frame.

16. An alignment surface for positioning a first body in precise alignment with the longitudinal axis of a second body, the second body being of the kind having at least a portion of its surface defining at least a portion of a cylinder, comprising, in combination:

a pair of convex curved surfaces, each surface having a longitudinal axis and being of uniform cross-section along the longitudinal axis, the cross-section of each surface defining the following curve $$y=a+bx+cx^2+dx^3$$

where a is approximately 1.0112, b is approximately 0.0345, c is approximately 0.1716 and d is approximately 0.0113, the surfaces being positioned with parallel longitudinal axis' and with each surface's convex curved side pointing generally in the direction of the other convex surface; and a surface between the parallel convex curved surfaces, rigidly connecting the convex surfaces and positioning the convex surfaces in spaced relationship to each other.

17. A method of determining plate register of a printing plate having register marks with a plate cylinder having a longitudinal axis in a web offset printing press, comprising the steps of:

aligning a block having a longitudinal axis of the plate cylinder, the block also having an alignment edge perpendicular to its longitudinal axis;

placing a scale against the blocks alignment edge, the scale having a straight linear edge with that edge aligned with the blocks alignment edge, and having a scale adapted to measure linearly along the longitudinal axis of the cylinder;

positioning the scale and block combination along the cylinders axis at the location of the plate's register marks while maintaining alignment with that axis; and reading the scale and register marks to determine register deviation of the plate.

18. A method as claimed in claim 17 wherein the step of reading the scale further comprises the steps of:

positioning the scale and block combination with the zero point of the scale corresponding to a first plate register mark;

sliding the scale linearly along its linear edge and along the block in the direction of the second register mark until the scale corresponds to the position of the second register mark; and reading the scale to determine the register deviation of the second register mark.

19. A method of determining alignment of components in a web offset printing press, comprising the steps of:

positioning an alignment block against a reference point in the press;

zeroing a displacement gauge, rigidly connected to the block, against a component in the press to be aligned;

repositioning the block and gauge combination against a second reference point in the press; and reading of the displacement registering on the gauge.

20. A method as claimed in claim 19, wherein the press is a color press with multiple color stages, and the component is the frame of one color stage of the press and the displacement gauge is zeroed and repositioned against the frame of a second color stage.

21. In an offset printing press cylinder having a longitudinal axis, and having a minor diameter radial surface for mounting plates or blankets, and further having a bearer ring with a greater major diameter radial surface, a method of determining differences in heights between the minor diameter radial surface and the major diameter radial surface, comprising the steps of:

aligning a block having a longitudinal axis, such that the block's longitudinal axis parallels the longitudinal axis of the cylinder, the block being on the minor diameter radial surface of the press cylinder, the block also having an attached displacement gauge configured to measure radial depth from the cylinder's minor diameter radial surface along a reference line parallel to the cylinder's axis;

zeroing the displacement gauge at the displacement reading of the seated block and gauge configuration along the reference line;

positioning the block and gauge configuration to indicate the displacement gauge reading to the cylinder's bearer ring major diameter radial surface from the reference line, the block being aligned with the cylinder's longitudinal axis; and reading the displacement indication of the gauge for the bearer ring major diameter radial surface, the difference in heights between the major and minor diameter radial surfaces then being the displacement gauge reading at the bearer ring major diameter radial surface.

22. In an offset printing press plate or blanket cylinder having a longitudinal axis with packing beneath the plate or blanket on a minor diameter radial surface, and having a bearer ring with a major diameter radial surface greater than the diameter underneath the wrapped and packed plate or blanket cylinder minor diameter radial surface, a method of determining differences in heights between the bearer ring major diameter radial surface and the packed minor diameter radial plate or blanket surface, comprising the steps of:

aligning a block having a longitudinal axis, such that the block's longitudinal axis parallels the longitudinal axis of the cylinder, the block being seated on the radial surface of the plate or blanket, the block also having an attached displacement gauge configured to measure radial depth of the plate or blanket surface along a reference line parallel to the cylinder's axis;

zeroing the displacement gauge at the displacement reading of the seated block and gauge configuration along the reference line;

positioning the block and gauge configuration to indicate the displacement gauge reading to the cylinder's bearer ring radial surface from the reference line, the block being aligned on the cylinder's plate or blanket packed radial surface with the cylinder's longitudinal axis; and reading the displacement indication or measurement from the gauge to the bearer ring radial surface, the difference in heights between the bearer ring radial surface and the radial plate or blanket surface then being the displacement gauge reading.

23. In an offset printing press cylinder having a longitudinal axis, with a plate wrapped about the cylinder, a method of determining lock-up plate fit error in the vicinity of the lock-up slot of the plate, the plate and cylinder being in a web offset printing press, comprising the steps of:

aligning a block having a longitudinal axis, such that the block's longitudinal axis parallels the cylinder's longitudinal axis, the block being on the surface of the radial plate, the block also having an attached displacement gauge and being configured to measure radial depth of the plate's surface along a circumferential reference line about the cylinder's axis;

zeroing the displacement gauge at the displacement reading of the seated block and gauge configuration along the circumferential reference line;

positioning the block and gauge configuration to indicate radial displacement or discontinuities of the plate surface near the lock-up slot along the circumferential reference line, the block being aligned with the cylinder's radial and longitudinal aixs; and reading the displacement indications of the gauge for the plate surface near the lock-up slot.

* * * * *